United States Patent [19]

Musser

[11] 4,413,572

[45] Nov. 8, 1983

[54] ADJUSTABLE SUPPORT ASSEMBLY FOR OPEN HEARTH FURNACE

[75] Inventor: John J. Musser, Kansas City, Mo.

[73] Assignee: George P. Reintjes Company, Inc., Kansas City, Mo.

[21] Appl. No.: 472,729

[22] Filed: Mar. 7, 1983

[51] Int. Cl.[3] ..... F23M 5/06

[52] U.S. Cl. ..... 110/331; 110/335; 432/247

[58] Field of Search ..... 110/181, 335, 331, 332, 110/333, 338, 339; 432/247, 248, 251, 252

[56] References Cited

U.S. PATENT DOCUMENTS

| | | | |
|---|---|---|---|
| 2,529,607 | 11/1950 | Hever | 110/333 |
| 2,963,997 | 12/1960 | Copeland et al. | 110/335 |
| 3,144,842 | 8/1964 | Murray | 110/335 |
| 3,183,865 | 5/1965 | Ross | 110/335 |
| 3,326,151 | 6/1967 | Copeland | 110/335 |

*Primary Examiner*—Henry C. Yuen

*Attorney, Agent, or Firm*—Schmidt, Johnson, Hovey & Williams

[57] ABSTRACT

The brackets connecting the furnace roof support beams to the buckstays of an open hearth furnace sidewall are reversible to provide for vertical shifting of the furnace roof support structure. The support brackets comprise a pair of symmetrical bracket pieces each having two generally vertically aligned sidewall connection points, and a support beam connection point vertically offset from the centerpoint defined by the sidewall connection points, such that the elevation of the support beam connection point is shifted when the vertical orientation of the sidewall connection points is reversed. The elevation of the roof support structure is thereby easily shifted, and refractory blocks of differing longitudinal lengths may therefore readily be incorporated into the furnace roof structure.

3 Claims, 5 Drawing Figures

Fig. 1
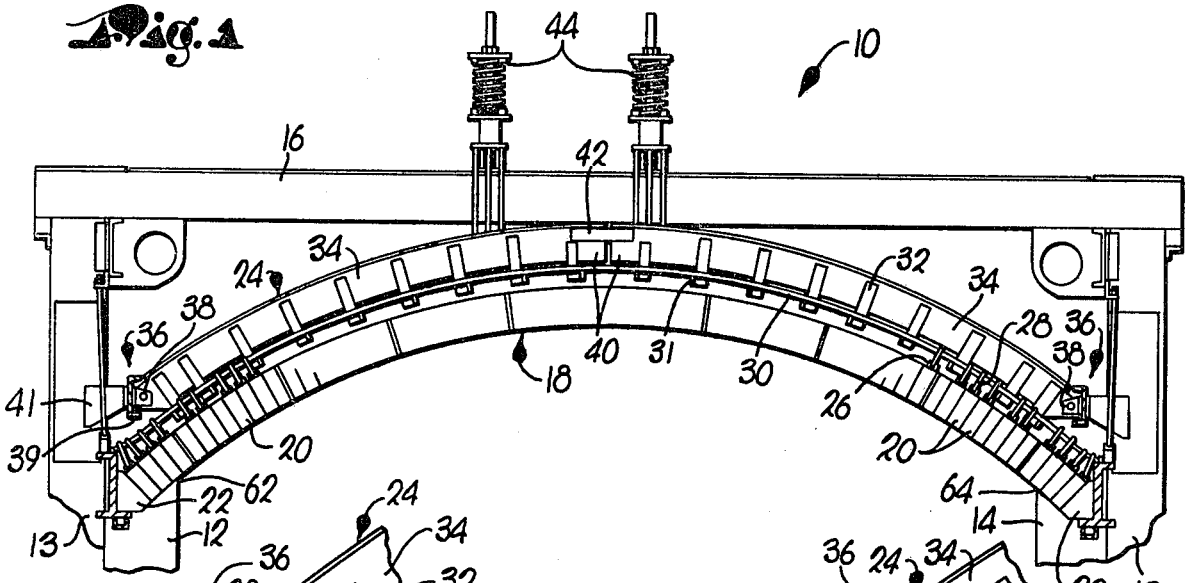
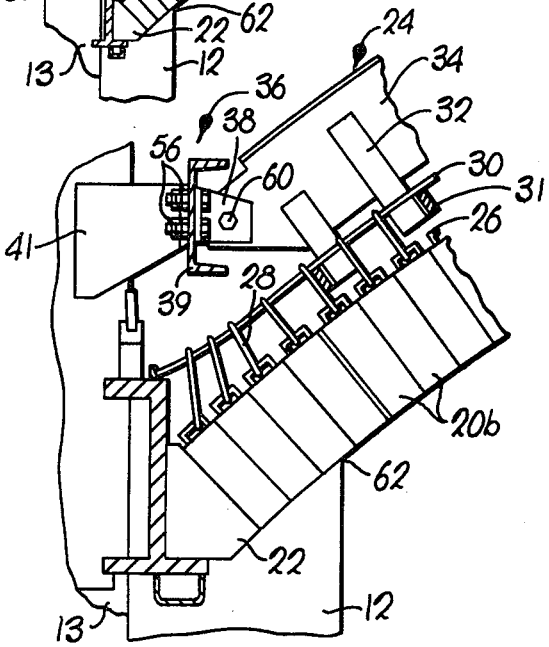
Fig. 2
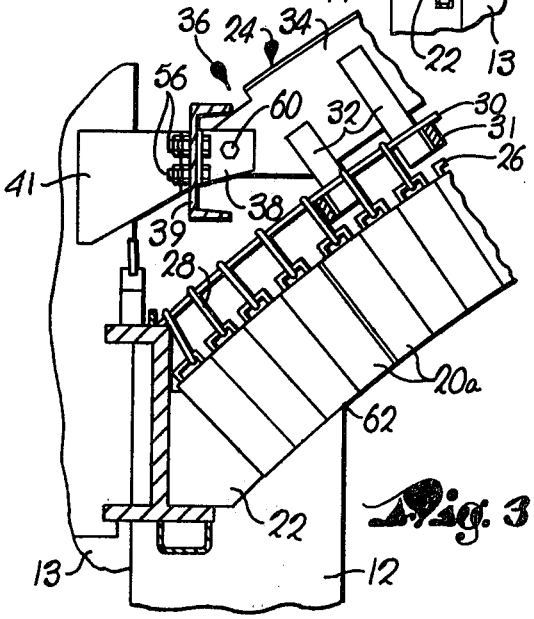
Fig. 3
Fig. 4
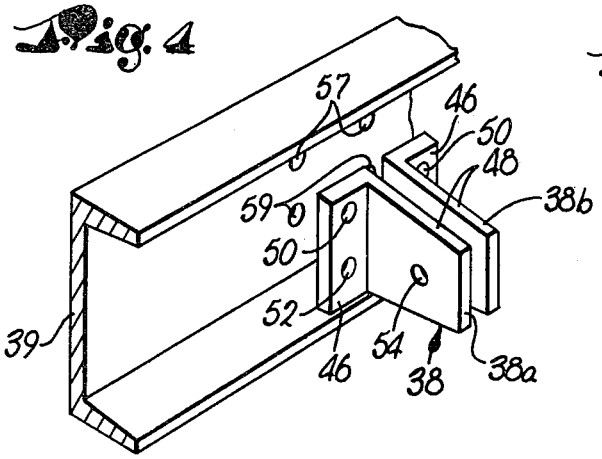
Fig. 5
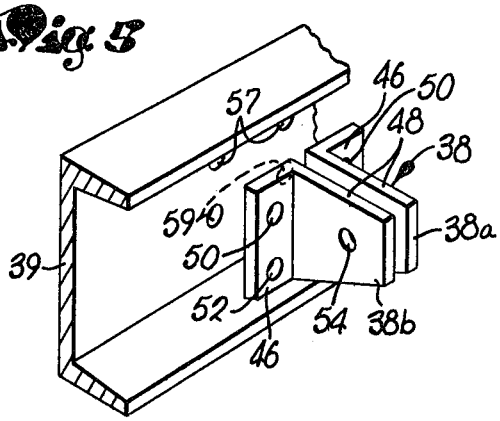

ADJUSTABLE SUPPORT ASSEMBLY FOR OPEN HEARTH FURNACE

BACKGROUND OF THE INVENTION

1. Field of the Invention

This invention relates to an adjustable support assembly for open hearth furnace roofs of simple yet highly effective construction that effects vertical shifting of the furnace roof support structure when the vertical orientation of the assembly is reversed, allowing an increase in the thickness of the roof without changing the dimensions of the furnace interior. More particularly, it is concerned with a furnace roof support assembly comprising a pair of symmetrical bracket pieces, each piece including a pair of generally vertically aligned sidewall connection points and a roof support connection point vertically offset from the centerpoint defined by the sidewall connection points.

2. Description of the Prior Art

Industrial furnaces include arched roofs formed from a plurality of refractory blocks. The refractory blocks are supported by arched beams spanning between the furnace sidewalls. The refractory blocks are subject to rapid degradation by the intense heat generated within the furnace, and must be replaced on a regular basis.

It is sometimes desirable to use refractory blocks having different longitudinal lengths than the longitudinal lengths of previously used blocks when refrabricating the furnace roof. Installation of blocks having different longitudinal lengths from the lengths of previously used blocks, however, requires shifting of the block support structure, since it is desirable to maintain the interior dimensions of the furnace. Shifting the support structure can be a time-consuming and awkward procedure. An adjustable support assembly for open hearth furnace roofs that would easily accommodate installation of refractory blocks having varied longitudinal lengths would therefore be a decided advantage.

SUMMARY OF THE INVENTION

The problem outlined above is in large measure solved by the adjustable support assembly for open hearth furnace roofs in accordance with the present invention. That is to say, the support assembly hereof easily accommodates installation of refractory blocks having different longitudinal lengths than the longitudinal lengths of previously used blocks without changing the interior dimensions of the furnace when fabricating the furnace roof, by allowing for the vertical shifting of the roof support structure bracket for connecting the roof support structure to the buckstays of the furnace sidewall. The bracket is comprised of a pair of symmetrical bracket pieces. Each bracket piece has a sidewall-connecting portion having first and second vertically oriented bolt-receiving apertures therethrough, and an arch-supporting portion including a single bolt-receiving aperture therethrough that is vertically offset from the centerpoint defined by the sidewall-connecting portion apertures. Reversing the vertical orientation of the bracket pieces shifts the elevation of the arch-supporting aperture, thereby easily accommodating the vertical shifting of the furnace roof support structure.

BRIEF DESCRIPTION OF THE DRAWINGS

FIG. 2 is a fragmentary, elevational view of the furnace roof and associated structure;

FIG. 2 is an enlarged, fragmentary view of the furnace roof and associated structure at the boundary line of the roof and furnace sidewall;

FIG. 3 is similar to FIG. 2 but depicts the furnace roof having refractory blocks of different longitudinal lengths than the blocks depicted in FIG. 2;

FIG. 4 is an enlarged, fragmentary, exploded view of a roof support bracket in accordance with the present invention juxtaposed with the sidewall support structure; and FIG. 5 is similar to FIG. 4 but depicts the support bracket in reverse vertical orientation.

DETAILED DESCRIPTION OF THE PREFERRED EMBODIMENT

Referring to the drawing, an open hearth furnace 10 includes spaced apart sidewalls 12 and 14 that include upright supporting buckstays 13, an overhead frame member 16 interconnecting sidewalls 12, 14, and a sprung arch 18 spanning the distance between the sidewalls 12, 14.

The sprung arch 18 comprises a plurality of refractory bricks or blocks 20 supported by skewbacks 22 and arched support frame 24. The blocks 20 include hangers 26 which suspend the blocks 20 from supports 28. The supports 28 are suspended from lateral stringers 30 that are supported by longitudinal bars 31 that are in turn supported by arms 32. The arms 32 are connected to a plurality of arched beams 34 arranged in pairs. The hangers, supports, stringers, bars, and arms comprise a support means of given length depending from the arched beams 34 for supporting the blocks 20. The arched beams 34 are pivotally connected at their outer end 36 to their respective furnace sidewall by brackets 38. The brackets 38 are supported by beams 39. The beams 39 are connected to respective buckstays 13 by supports 41. The inner ends 40 of each pair of arched beams 34 are shiftably interconnected by a slip plate 42.

The above described furnace roof structure is designed to accommodate the shifting of the arch 18 due to the expansion of the blocks 20 as they are heated. Spring actuated structures 44 are mounted on frame member 16 for the control of pressure buildup in arch 18 as the arch heats and expands.

Each bracket 38 is comprised of a pair of bracket pieces **38*a*, 38*b*. Each piece includes a sidewall connection portion 46 and an arch-supporting portion 48 oriented at a right angle relative to the sidewall connection portion. The sidewall connection portion 46 includes first and second spaced apart, vertically oriented sidewall connection points comprising bolt-receiving apertures 50, 52. The arch-supporting portion 48 includes a beam connection point comprising a single bolt-receiving aperture 54 therethrough. The arch portion aperture 54 is vertically offset from the horizontal plane that intersects the centerpoint between sidewall portion apertures 50, 52. Nut and bolt assemblies 56 connect each bracket piece 38*a*, 38*b* to a support beam 39 on respective furnace sidewalls at upper and lower sidewall junction point apertures 57, 59. A single nut and bolt assembly 60 received through the support portion aperture 54 pivotally connects the outer end 36 of a beam 34 to bracket 38**.

Each block 20 includes a lowermost, chamber directed face and a longitudinal length generally perpendicular to the chamber directed face. The block faces collectively comprise an arcuate top wall that, in conjunction with sidewalls 12, 14 define a furnace chamber.

The arch defined by the furnace top wall intersects the sidewalls 12, 14 at boundary lines 62, 64.

Comparing FIG. 2 with FIG. 3 it will be noted that the longitudinal lengths of the blocks 20*a* in FIG. 3 are longer than the longitudinal lengths of the blocks 20*b* in FIG. 2. Notwithstanding the difference of longitudinal lengths, however, it will be noted that the arch defined by the furnace top wall in both FIG. 2 and FIG. 3 intersects the sidewall 12 at the same vertical orientation, even though the given length of the support means comprised of the hangers, the support stringers and arms depending from the beams 34 is of identical length in both furnace constructions as depicted in FIGS. 2 and 3. The vertical orientation of the boundary line 62 is maintained at a constant elevation in both of the top wall constructions depicted in FIG. 2 and FIG. 3 because the bracket 38 depicted in FIG. 3 is in reverse vertical orientation from the bracket 38 depicted in FIG. 2. That is to say, and referring to exploded FIGS. 4 and 5 which correspond to FIGS. 2 and 3, respectively, the first connection points or apertures 50 are depicted in FIG. 1 as being aligned with the upper sidewall junction point 57, and the second connection points 52 are aligned with the lower sidewall junction points 59.

In FIG. 5, however, the first connection points 50 are aligned with the lower sidewall junction points 59, and the second bracket connection points 52 are aligned with the upper sidewall junction points 57. The vertical orientation of the beam junction point or aperture 54 is accordingly vertically shifted so as to maintain the beam 34 at a higher elevation in the construction depicted in FIG. 3 than the elevation that it is maintained at in the construction depicted in FIG. 2. The extended longitudinal lengths of the blocks 20*a* depicted in FIG. 3 are therefore accommodated, maintaining the boundary line 62 between the furnace top wall and sidewall at a constant elevation.

I claim:

1. In combination with a furnace chamber having spaced sidewalls, a roof for said chamber comprising:

a plurality of refractory blocks, each block having a lowermost, chamber directed face and a longitudinal length generally perpendicular to said face, said faces collectively comprising an arcuate top wall to said chamber and defining an arch that intersects said sidewalls at a boundary line;

a plurality of spaced beams arranged in pairs, each pair spanning between said sidewalls and each beam adapted at its outer end for pivotal coupling to one of said sidewalls, the inner ends of each pair of beams being pivotally interconnected;

support means of a given length depending from said beams and being operably coupled to said blocks for supporting said blocks;

a plurality of reversible brackets pivotally mounting said outer ends of said beams to respective sidewalls of said furnace, each bracket including a sidewall-connecting portion having first and second, spaced apart, sidewall connection points defining a vertically oriented line and a centerpoint therebetween, an arch-supporting portion having a beam connection point, means for connecting said sidewall connection points to one of said sidewalls at first and second sidewall junction points and means for pivotally connecting the outer end of one of said beams to said beam connection point, said beam connection point being vertically offset from said centerpoint, whereby said beam connection point is oriented in a first position when said first sidewall connection point is aligned with said first junction point and said second sidewall connection point is aligned with said second junction point, and said beam connection point is oriented in a second position vertically offset from said first position when said first connection point is aligned with said second junction point and said second connection point is aligned with said first junction point, thereby shifting the elevation of said outer end of said one of said beams to accommodate installation of said refractory blocks having varied longitudinal lengths without shifting the vertical orientation of said boundary line.

2. The combination as claimed in claim 1, each of said brackets comprising a first bracket piece, said combination including a second bracket piece associated with each of said first pieces, said first and second pieces being symmetrical with respect to each other.

3. The combination as claimed in claim 1, said sidewalls including supporting buckstays, said brackets operably connected to said buckstays.

* * * * *